United States Patent [19]

Wirth

[11] 4,357,585

[45] Nov. 2, 1982

[54] LAMINATED MAGNETIC SWITCH

[75] Inventor: Gary J. Wirth, Milwaukee, Wis.

[73] Assignee: W. H. Brady Co., Milwaukee, Wis.

[21] Appl. No.: 101,834

[22] Filed: Dec. 10, 1979

[51] Int. Cl.[3] ..... H01H 9/00

[52] U.S. Cl. ..... 335/205; 335/154

[58] Field of Search ..... 335/151, 152, 154, 196, 335/199

[56] References Cited

U.S. PATENT DOCUMENTS

| | | | |
|---|---|---|---|
| 3,383,487 | 5/1968 | Wiener | 335/2 X |
| 3,739,117 | 6/1973 | Welton | 335/205 X |
| 3,859,612 | 1/1975 | Kashio | 335/205 |
| 4,068,202 | 1/1978 | Lyons | 335/205 X |

*Primary Examiner*—George Harris

[57] ABSTRACT

A laminated reed switch assembly in which the reed is movable between two positions, in one of which it contacts two pole pieces.

12 Claims, 16 Drawing Figures

LAMINATED MAGNETIC SWITCH

FIELD OF THE INVENTION

This invention relates to magnetically actuated thin reed switches.

BACKGROUND OF THE INVENTION

Reed switches are well known in the art. My colleague John. D. Dick suggested to me, before my conception of my inventions claimed herein, that a thin reed switch might be constructed using a pair of layer bits of magnetically responsive material laminated to spaced flexible plastic sheets, whereby moving a magnet external to the switch relatively to it would cause the bits to move together to actuate the switch.

SUMMARY OF THE INVENTION

I have discovered that an improved switch assembly may be provided by using a magnetizable reed movable between two positions, in one of which it is in contact with two magnetizable pole pieces.

In preferred embodiments the pole pieces are defined by common planes, the reed is provided with contact portions of reduced area, the reed is provided with taut mounting at its end closer to a pole piece, the reed is adhesively secured to a supporting layer, and certain layers are relieved to cooperatively provide space connections.

PREFERRED EMBODIMENT

I turn now to description of the drawings and the structure and operation of a preferred embodiment.

DRAWINGS

STRUCTURE

Figure 1:
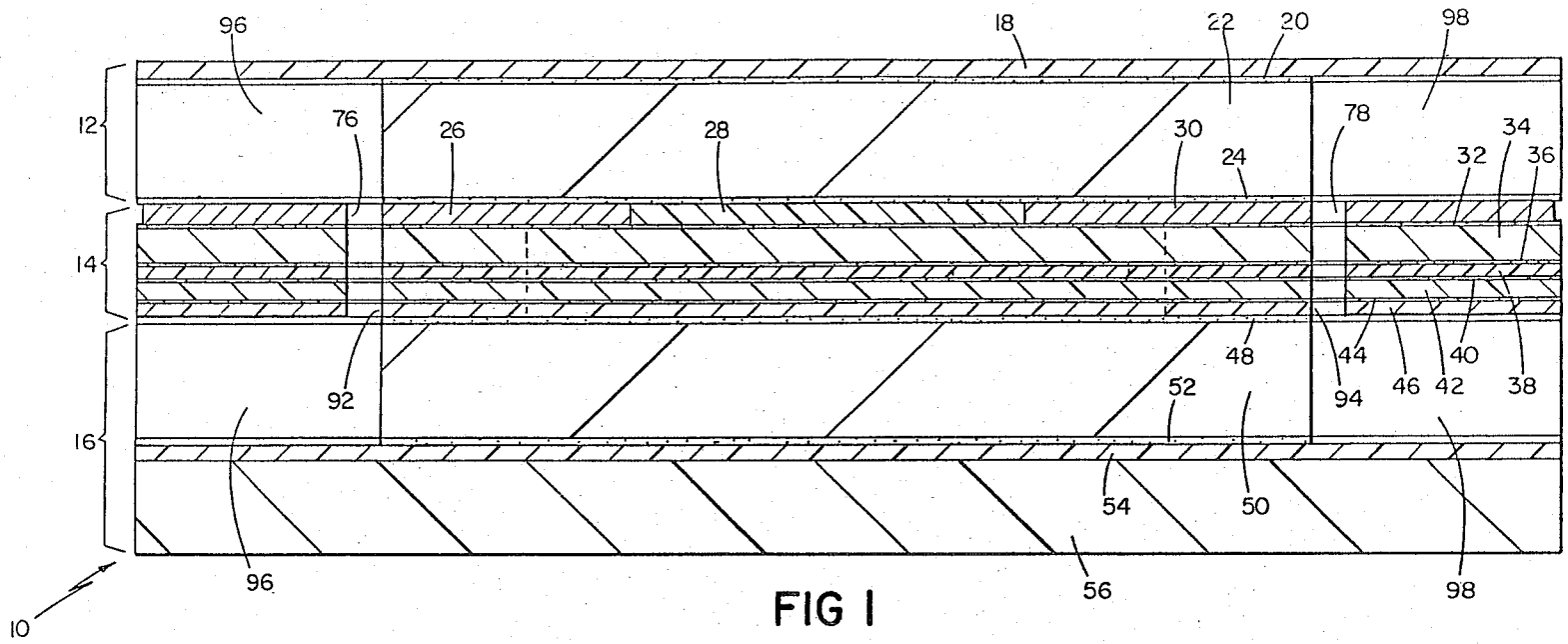
FIG. 1 is a vertical sectional view, taken at 1—1 of FIG. 3, of a switch according to the invention.

There is shown in FIG. 1 a switch assembly indicated generally at 10. Switch assembly 10 includes top portion 12, core portion 14, and bottom portion 16.

Top portion 12 consists of top sheet 18 of 0.005 inch thick polycarbonate having a decorated finish. Layer 18 is secured by adhesive 20 to top spacer 22, of 0.032 inch thick polycarbonate. Top spacer 22 is adhered by layer 24 of adhesive to pole piece 26, pole filler 28, and pole piece 30. Pole pieces 26 and 30 are formed from 0.006 inch layers of magnetic material (a fifty percent nickel, fifty percent iron alloy sold by Magnetic Metals Co. under the trademark HIGH PERM 49), fully annealed and bearing on each side a 0.0003 inch thickness of nickel plate. Secured to the lower surfaces of elements 26, 28 and 30 by a layer of adhesive 32 is pole spacer 34, which is formed of 0.010 inch thick polyester and adhered through adhesive 36 to suspension element 38, formed of 0.003 inch thick polyester. Secured beneath element 38 through adhesive 40 is reed spacer 42, formed of 0.005 inch thick polyester. Secured therebeneath by adhesive 44 is cover sheet 46, formed of 0.003 inch thick polyester. Secured therebeneath through adhesive 48 is base spacer 50, formed of 0.032 inch thick polycarbonate. Secured therebeneath through adhesive 52 is base sheet 54, of 0.003 inch thick polyester. Adhered therebeneath, and shown somewhat diagramatically (the upper adhesive layer attaching it to element 54 is not separately shown, nor is the release sheet at the absolute bottom) is double stick tape element 56.

Figure 4A:
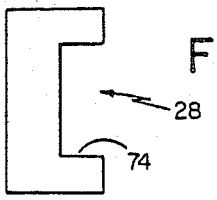
FIGS. 4A through 4I are plan views of elements of the FIG. 1 combination.
Figures 4B, 4C:
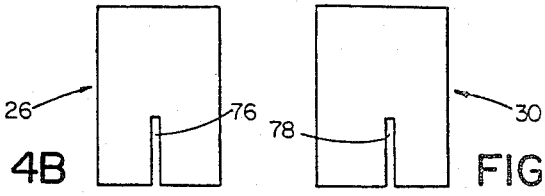
Figure 4D:
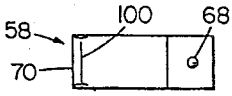
Figure 4E:
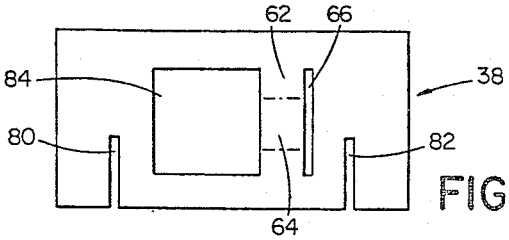
Figure 4F:
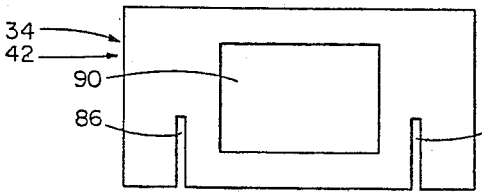
Figure 4G:
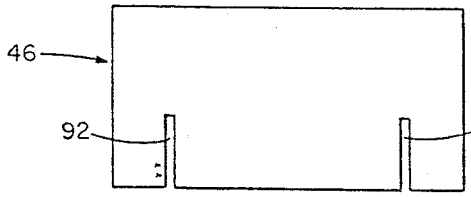
Figure 4H:
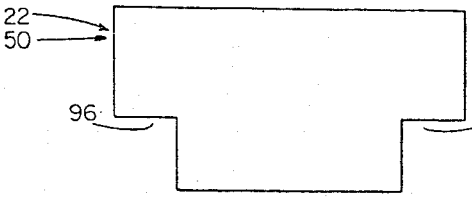
Figure 4I:
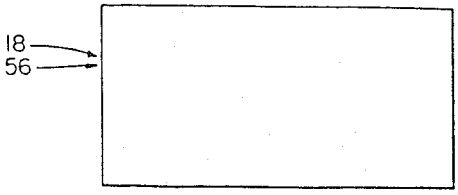

Plan views of each of the non-adhesive elements referred to are set forth in FIGS. 4I (top sheet 18), 4H (top spacer 22), 4B (pole piece 26), 4A (pole filler 28), 4C (pole piece 30), 4F (pole spacer 34), 4E (suspension element 38), 4F (reed spacer 42), 4G (cover sheet 46), 4H (base spacer 50), 4I (base sheet 54), and 4I (double stick tape element 56).

Figure 2:
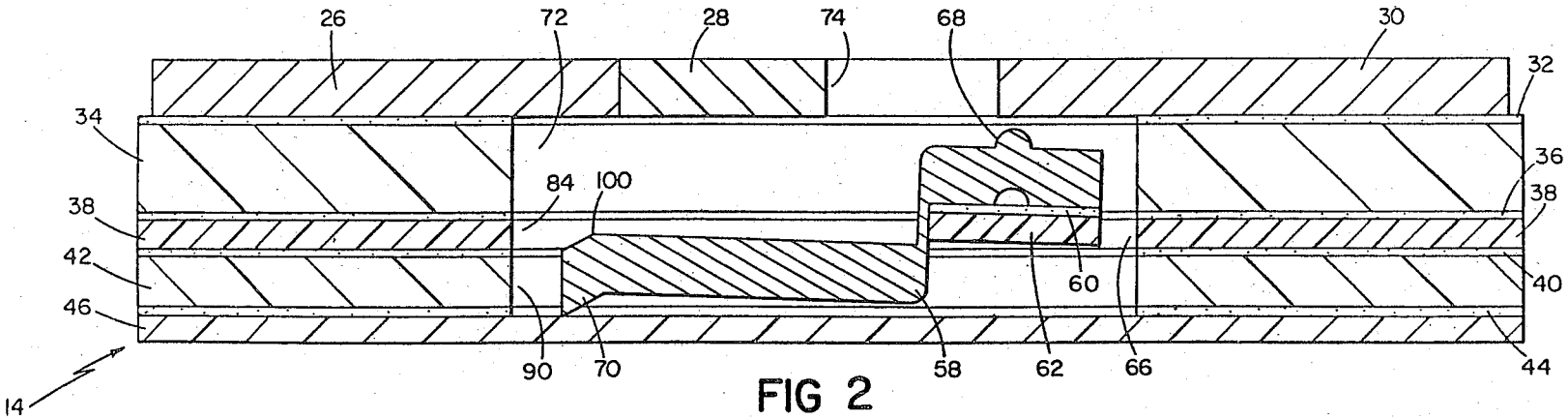
FIG. 2 is a vertical sectional view, taken at 2—2, of a portion of said switch.
Figure 3:
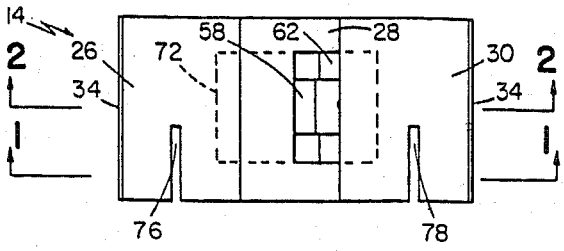
FIG. 3 is a plan view of said portion of said switch.

FIG. 2 is a section through the core portion, indicated generally in this view, at 14. In this view, in which the section is taken centrally of the switch assembly rather than as in FIG. 1, there is shown a reed 58 secured by adhesive layer 60 on suspension band portion 62 of suspension element 38; the area 64 over which the adhesive extends is indicated by the dashed lines in FIG. 4E. (Both FIG. 1 and FIG. 2 are drawn to different scales in a width direction and in a thickness direction; the extent of the difference is virtually manifest in FIG. 2 in the apparent change of thickness in the uprising portion of reed 58; in actuality the spacer is the same thickness throughout.) Reed 58 is downwardly offset in its lowermost portion 70. Reed 58 is positioned in zone 72 defined by open portions in pole spacer 34, suspension element 38, and reed spacer 42. Reed 58, which is shown in plan view in FIG. 4D, is formed of the 0.006 inch thick material, HIGH PERM 49, of transformer grade and fully annealed, to which we have already referred.

Turning to the plan views of various elements there is shown in FIG. 4A the notch 74 in pole filler 28. In FIG. 4B is shown slot 76 in pole piece 26. In FIG. 4C is shown slot 78 in pole piece 30. In FIG. 4E are shown slots 80, 82 and rectangular opening 84 in suspension element 38. In FIG. 4F are shown slots 86, 88 and rectangular opening 90 in pole spacer 34 and reed spacer 42, which are both shown in plan view in this figure. In FIG. 4G are shown slots 92, 94 in cover sheet 46. In FIG. 4H are shown cut out portions 96, 98 in the bottom left-hand and right-hand corners, respectively, of top spacer 22 and base spacer 50, which are both shown in plan view of this figure.

In manufacture, the core assembly 14, which results in a fully operable switch, is completed and other sheets are added thereafter.

The laminated character of the device permits use of sheet construction techniques enabling assembly simultaneously of a number of switches, with separation then as a later production step.

OPERATION

Movement of a magnet (not shown, and which need not be permanent) toward the central portion of the thin magnetic switch 10 creates a magnetic path which first closes the gap between upper dimple 68 and pole piece 30 (unless the two were already in contact). Reed 58 then rocks about dimple 68 twisting suspension band 62 to bring edge 100 into contact with pole piece 26 to complete a circuit which is maintained closed so long as the magnet remains in close enough proximity; when this is no longer true, untwisting of suspension band 62 causes reed 58 to return to the position shown in FIG. 2.

The generally C-shaped (in cross-section) openings defined by relieved portion 96, 98; 76, 78; 86, 88; 80, 84; and 92, 94 provide for contact with the switch assembly through spade connections to be made with two female spade connectors, which can be introduced by movement in the direction to the paper in FIG. 1.

Provision of the dimple 68 not only facilitates pivoting of reed 58, but it as well centralizes mechanical force on reed 58, provides for more focused and better electrical contact, and aids in optimizing magnetic flux line patterns. Positioning dimple 68 centrally of suspension band 62, directly above the axis of rotation of suspension band 62, prevents transfer through the reed of forces on the dimple 68 when it engages portion 30. Provision of line contact 100 also facilitates electrical contact and magnetic flux conditions.

The slot 66 in suspension element 38 permits greatly increased flexibility of the suspension portion 62 and even when pole piece 30 actually contacts dimple 68 helps to prevent undesirable transfer of mechanical forces from that end portion of the reed to the other end portion thereof.

What is claimed is:

1. A switch which comprises a multiplicity of thin layers and a reed, said reed being mounted for movement between a first position and a second position in an opening defined by certain of said thin layers, said reed being formed of material responsive to magnetic forces, said layers including also a first pole piece and a second pole piece, said reed being in contact with both said pole pieces in one of said two positions.

2. The switch of claim 1 in which both said pole pieces are defined by common planes.

3. The switch of claim 1 in which said pole pieces and said reed are formed of material characterized by high magnetic flux density and low retentive magnetism.

4. The switch of claim 1 in which said reed is centrally offset to provide first and second end portions, said end portions being defined by generally planar surfaces which are not coplanar.

5. The switch of claim 4 in which both said end portions include contact areas limited in comparison with the areas of said end portions.

6. The switch of claim 5 in which said contact area in said first end portion is provided by a dimple and said contact area of said second end portion is provided along a line.

7. The switch of claim 1 in which a slot is provided in a layer to which said reed is secured, said slot being adjacent the portion of said reed along which said reed is mounted, whereby taut mounting is provided to facilitate free movement of said reed between said positions and whereby the effect of forces in one end of said reed on the other end of said reed are minimized.

8. The switch of claim 7 in which said reed is adhesively secured to its supporting layer.

9. The switch of claim 1 in which certain adjoining of said thin layers are relieved adjacent corresponding edges thereof to provide a spade connection portion.

10. A multilayer switch which comprises a cover sheet layer, a reed spacer layer having a reed opening therethrough, said reed spacer layer being mounted on top of said cover sheet layer, a suspension layer mounted on said reed spacer layer and having a suspension opening therethrough, said suspension opening being located over said reed spacer opening, a pole spacer layer mounted on said suspension layer and having a pole opening located over said suspension opening, a top layer including a first pole piece, a second pole piece and a pole filler located between said first and second pole pieces, portions of said first and second pole pieces extending over opposite ends of said pole opening, and a reed made of material responsive to magnetic forces mounted on said suspension layer for movement within said reed opening, said suspension opening and said pole opening between a first position and a second position, said reed being in contact with both said pole pieces in one of said two positions.

11. A switch assembly in which the switch of claim 10 is sandwiched between an upper assembly including a top spacer layer and a top sheet layer mounted on top of said top spacer layer and a lower assembly including a base spacer layer, a base sheet layer mounted to the bottom of said base spacer layer, and a double stick tape layer mounted to the bottom of said base sheet layer.

12. The switch of claim 7 in which said reed includes a contact area limited in comparison with an end portion area, said contact area being positioned directly over the axis of rotation of said portion of said reed along which said reed is mounted.

* * * * *